United States Patent [19]

Bliss

[11] Patent Number: 4,564,443

[45] Date of Patent: Jan. 14, 1986

[54] REVERSE CENTRIFUGAL CLEANING OF PAPER MAKING STOCK

[75] Inventor: Terry L. Bliss, Middletown, Ohio

[73] Assignee: The Black Clawson Company, Middletown, Ohio

[21] Appl. No.: 728,164

[22] Filed: Apr. 30, 1985

Related U.S. Application Data

[63] Continuation of Ser. No. 513,579, Jul. 14, 1983, abandoned, which is a continuation-in-part of Ser. No. 384,835, Jun. 4, 1982, abandoned.

[51] Int. Cl.[4] ..... B04C 3/06

[52] U.S. Cl. ..... 209/211; 210/512.1; 209/144

[58] Field of Search ..... 209/211, 144; 210/512.1, 512.2; 55/428, 430, 496, 459 R, 459 A, 459 B, 459 C; 222/464; 134/166, 167; 239/601

[56] References Cited

U.S. PATENT DOCUMENTS

| | | | |
|---|---|---|---|
| 341,533 | 5/1886 | Wolfram | 272/59 |
| 2,645,346 | 1/1953 | Staege et al. | 209/211 |
| 2,843,265 | 7/1958 | Rakowsky | 209/211 |
| 3,417,871 | 12/1968 | Arnold | 209/211 |
| 3,861,532 | 1/1975 | Skardal | 209/211 |
| 3,893,914 | 7/1975 | Bobo | 209/211 |
| 3,940,331 | 2/1976 | Rastatter | 209/211 |
| 4,148,723 | 4/1979 | Mozley | 209/211 |
| 4,155,839 | 5/1979 | Seifert et al. | 209/211 |
| 4,356,084 | 10/1982 | Hatton | 209/211 |
| 4,378,289 | 3/1983 | Hunter | 209/211 |
| 4,414,112 | 11/1983 | Simpson et al. | 209/211 |
| 4,473,478 | 9/1984 | Chirrall | 209/211 |

FOREIGN PATENT DOCUMENTS

| | | | |
|---|---|---|---|
| 62010 | 5/1975 | Australia | 209/211 |
| 789373 | 7/1968 | Canada . | |
| 0058484 | 1/1982 | European Pat. Off. . | |
| 953601 | 12/1956 | Fed. Rep. of Germany | 209/211 |
| 2009632 | 6/1979 | United Kingdom | 209/211 |
| 390838 | 12/1973 | U.S.S.R. | 209/211 |
| 982819 | 12/1982 | U.S.S.R. | 209/211 |

OTHER PUBLICATIONS

Through Flow Cleaners and their Applications—Terry Bliss—1984.

Reverse Cleaning—Terry Bliss—1980.

Beloit Uniflow Cleaners—published Sep., 1983.

Advertisement—BC Shartle—Pandia Div.—entitled Now There is a Choice in Light Contaminant Removal.

*Primary Examiner*—Frank W. Lutter

*Assistant Examiner*—Wm. Bond

*Attorney, Agent, or Firm*—Biebel, French & Nauman

[57] ABSTRACT

A system for separating paper fibers from contaminants of similar lower specific gravities employs a reverse centrifugal cleaner wherein the discharge port for lights (reject) is located at the apex of the internally conical cleaner body and is formed by a tube which has it inner end located in the open apex end of the cleaner body and of smaller diameter to define with the end of the body an annular discharge outlet for heavies (accepts), the tube being releasably secured in position so that it can be temporarily retracted to relieve blockage of the heavies outlet.

5 Claims, 5 Drawing Figures

REVERSE CENTRIFUGAL CLEANING OF PAPER MAKING STOCK

RELATED APPLICATIONS

This application is a continuation of application Ser. No. 513,579, filed July 14, 1983 as a continuation-in-part of application Ser. No. 384,835, filed June 4, 1982, both of which prior applications have now been abandoned.

BACKGROUND OF THE INVENTION

Centrifugal cleaners have been employed for many years in the paper industry for removing small particles of higher specific gravity than paper fibers from slurries of paper making fiber, especially waste paper stocks.

In centrifugal cleaners used for that purpose, in what is hereinafter referred to as "conventional centrifugal cleaning technique," the discharge outlet at the apex (tip) of the cylindrical-conical vessel is relatively small in comparison with the inlet and accepts outlets, e.g. $\frac{1}{8}$ inch in diameter as compared with $\frac{5}{8}$ inch diameters for the other two ports in a conventional cleaner 3 inches in diameter. In such conventional cleaning operations, therefore, the reject discharge through the apex outlet is correspondingly small in comparison with the accepts flow, e.g. 3% and 97% by volume respectively.

In comparatively recent years, there has been an increasing use of centrifugal cleaners to separate good paper fibers from contaminants of closely similar or lower specific gravity such that they cannot be readily separated by conventional centrifugal cleaning technique.

In general, cleaners for such "reverse" centrifugal cleaning have been made by modifying the construction and/or operation of a conventional cleaner to provide operating conditions which cause the good fiber to be discharged through the apex outlet as the accepts flow while the lights are discharged as reject through the base (top) outlet which is the accepts outlet in conventional centrifugal cleaning. For an extended discussion of prior and up dated reverse centrifugal cleaning developments, reference is made to Seifert et al. U.S. Pat. No. 4,155,839 wherein the present inventor was a joint patentee.

SUMMARY OF THE INVENTION

A primary object of this invention is to provide an improved centrifugal cleaner particularly adapted for reverse centrifugal cleaning wherein both of the discharge ports, for the two fractions into which the cleaner separates the feed flow, are located adjacent the apex end of the cleaner, so that there is no reversal of flow within the cleaner as in past practice for both conventional and reverse cleaning.

More specifically, in a reverse centrifugal cleaner in accordance with the invention, the apex outlet, which heretofore has been used as the outlet for the "heavy" fraction, whether it be reject in conventional cleaning or accepts in reverse cleaning, becomes the outlet for the light fraction which constitutes rejects in reverse centrifugal cleaning. The cleaner of the invention is provided with a second discharge outlet in its side wall, and preferably at the downstream end of the conical portion of the interior of the cleaner, which is then the discharge outlet for the heavy fraction constituting the accepts flow in reverse centrifugal cleaning.

Thus in the practice of the invention, there is a through flow of the feed stock from the base end to the apex end of the cleaner, with no reverse flow through the central part of the cleaner as in both conventional and reverse cleaning as heretofore practiced. This feature is of particular value in the application of the invention to cyclone assemblies or "canister" cleaners wherein multiple individual centrifugal cleaners are assembled in parallel relation within a common canister whose interior is divided into feed, accepts and reject chambers which connect respectively with the inlet and discharge ports of all of the individual cleaners.

A special feature of the invention resides in the construction and assembly of the outlet for the light fraction, which comprises a tube releasably locked into position within the cleaner in such manner that in the event of blockage of the outlet for the heavy fraction from the cleaner body, this tube can be temporarily retracted to effect relief of the blockage.

DESCRIPTION OF THE PREFERRED EMBODIMENTS

Figure 1:
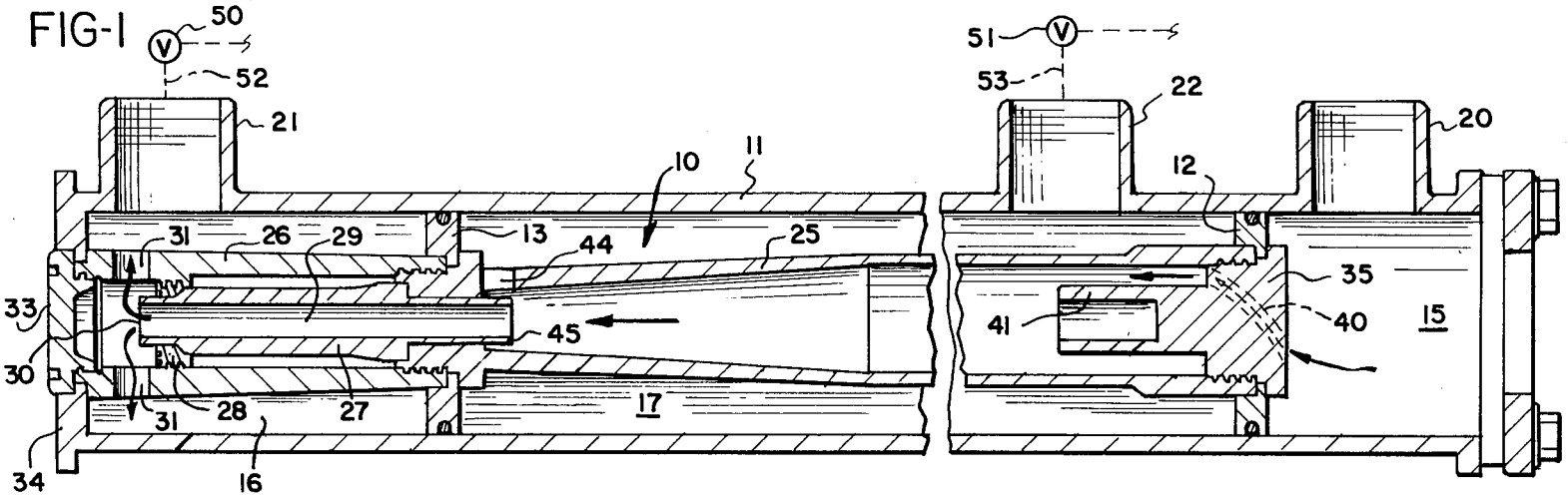
FIG. 1 is a view in axial section of a reverse cleaning unit in accordance with the invention.

A typical reverse centrifugal cleaner indicated generally at 10 is shown in FIG. 1 as housed in a casing 11 which has its interior divided by partitions 12 and 13 into a supply or feed chamber 15 at one end of the casing 11, a reject chamber 16 at the other end of the casing, and an accepts chamber 17 located intermediate the chambers 15 and 16, each of these chambers being provided with its own port 20, 21 and 22, respectively.

The cleaner 10 comprises a main tubular vessel 25 the interior of which is cylindrical over a portion of its length and frusto-conical throughout its remaining portion. A housing 26 is threaded on the smaller end of the vessel 25, and a tubular tip piece 27 is secured within the housing 26 by a retainer nut 28 as shown. The cylindrical bore 29 within the tip piece 27 forms a continuation of the interior of housing 25 which leads to the discharge port 30.

The housing 26 has one or more radially or tangentially arranged ports 31 therethrough which provide a total flow area larger than that of the port 30 leading into the interior of the reject chamber 16. The lower end of the housing 26 is closed by a threaded cap 33 which extends through an opening in the end wall 34 of the casing 11 and clamps the casing wall against the end of housing 26 to the casing wall. The base end of the vessel 25 provided with a closure plug 35 which is threaded into the end of the vessel 25 and also clamps the partition 12 between itself and the vessel 25.

A helical groove 40 on the outer surface of the plug 35 forms the inlet port to the interior of the cleaner vessel 25, the spiral configuration of this groove assuring that stock to be cleaned will be delivered from the interior of the feed chamber 15 to the interior of the vessel 25 with a substantial circumferential flow component. The plug 35 is otherwise solid, but it includes a cylindrical extension 41 on its inner end which acts in part as a vortex finder but more particularly as a stabilizer for the air core which forms during operation of the cleaner. The groove 40 may be duplicated around the periphery of plug 35 to increase the effective inlet port size as needed.

In addition to the outlet port 30 at its apex, the cleaner 10 is provided with one or more accepts outlet ports 44 at the lower end of the frusto-conical portion of vessel 25. The outlet ports 44 are preferably arranged tangentially of the vessel 25, in the same direction as the circulatory movement of stock within the vessel, and these ports lead into the chamber 15 within the casing 11. Preferably, the tip piece 27 includes a cylindrical extension 45 which projects upstream therefrom into the interior of the vessel 25 sufficiently far so that it at least radially overlies the outlet port or ports 44 and thus serves as a baffle preventing direct flow therefrom to the interior of tip piece 27 and the outlet port 30, and the upstream end of the extension 45 thus effectively is the apex outlet port of the vessel 25.

The inlet construction shown in FIG. 1 has special advantages in that it assures the all stock entering the cleaner will continue to flow with a substantial component lengthwise of the cleaner, rather than having some heavy particles tend to orbit the inlet end of the cleaner and thereby wear away its inner wall surface. The invention can be practiced, however, with the alternative inlet construction shown in FIG. 2, which is essentially the same as in the above noted U.S. Pat. No. 4,155,839.

It includes a plug 35' which differs from plug 35 only in having no groove 40 in its outer surface. Instead, an inlet port 40' of rectangular shape leads tangentially through the wall of vessel 25 as shown in U.S. Pat. No. 4,155,839. The position of the partition 12 with relation to the vessel 25' therefore has to be shifted so that the port 40' will be open to the feed chamber 15, i.e. so that partition 12 is to the left of port 40' in FIG. 2, and the partition 12 is therefore clamped between a shoulder 46 on the vessel 25' and a nut 47 threaded on the vessel 25' in opposed relation with the shoulder 46.

In the use of a cleaner of the construction described in connection with FIGS. 1 and 2, the slurry to be cleaned is delivered to the supply chamber 15 at the appropriate pressure to cause it to enter the inlet port 40 or 40' at the desired flow rate and velocity as described in U.S. Pat. No. 4,155,839, to develop within the vessel 25 centrifugal force conditions causing vortical separation of the slurry into an outer fraction containing the large majority of the paper fibers, an inner fraction containing the large majority of light contaminant particles, and commonly also an innermost air core.

The outer fraction will travel down the frusto-conical portion of the interior of vessel 25 until it reaches the accepts port or ports 44, and it will exit through those ports to the accepts discharge chamber 17 and its outlet port 22. The inner fraction will enter the upstream end of the extension 45 and travel therethrough and through the interior of the tip piece 27 and the outlet port 30 to the reject discharge chamber 16 and its port 21.

Separation of the heavy and light fractions which form within the cleaner as they discharge therefrom is readily controlled by regulating the respective discharge flows from the chambers 16 and 17, by means such as valves 50 and 51 on the lines 52 and 53 leading from the ports 21 and 22. Determination of the proper flow splits from the two discharge chambers will usually involve some experimentation, depending upon the nature of the feed stock, the feed flow rate and the feed pressure, and satisfactory results have been obtained under test conditions with this split varied from approximately equal flows from both discharge chambers to approximately 90% from the accepts chamber 17 and 10% from the reject chamber 16.

Figure 2:
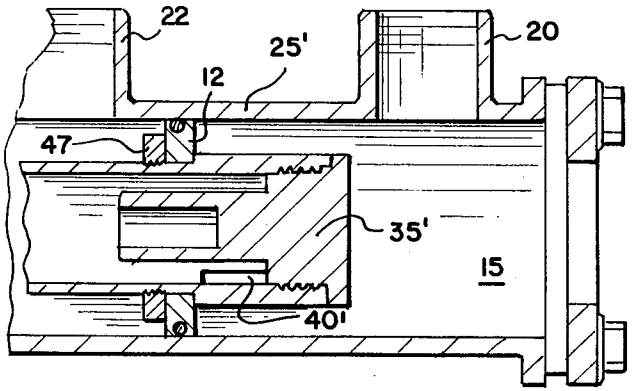
FIG. 2 is a fragmentary view similar to FIG. 1 and showing a modified inlet port arrangement.

As a more specific example of the practice of the invention, test runs were made with a cleaner, constructed as shown in FIG. 2 wherein the inlet port 40' had a flow area of 0.625 sq. in., the minimum flow area of the apex outlet port was 0.785 sq. in., and there were two outlet ports 44 each of a flow area of approximately 0.25 sq. in. In a test run wherein the feed flow rate was 50 gallons/minute at 30 p.s.i.g., satisfactory results were obtained with flows from the discharge chambers 16 and 17 of approximately 26 and 24 gallons/minute. Better results were obtained with a feed flow rate of 68 g.p.m. at a feed pressure of 40 p.s.i.g., and with the flows from the discharge chamber 16 and 17 at the rate of 54.5 and 13.5 g.p.m. respectively.

The invention has also been tested with a cleaner constructed as shown in FIG. 1 wherein the inlet port flow area was 0.625 sq. in., the minimum flow area of the apex port was 0.306 sq. in., and the accepts port 44 was rectangular, similarly to the inlet port 40' in FIG. 2, with dimensions of 1.5 inches$\times\frac{3}{8}$ in. and a flow area of 0.47 sq. in. Highly satisfactory results were obtained with a feed flow at 80 gallons/minute and a pressure of 45 p.s.i.g. with the flow from the chambers 16 and 17 at the rates of 8.5 and 71.9 gallons/minute.

Figure 3:
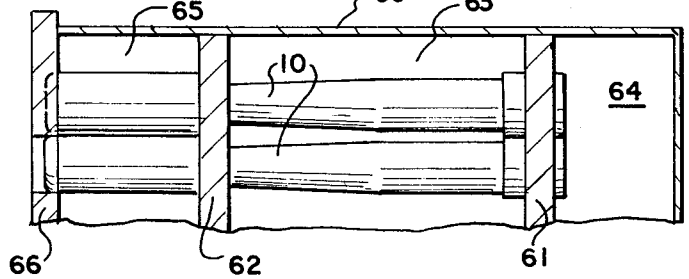
FIG. 3 is a fragmentary view illustrating the application of the invention to a canister-type cyclone assembly.

As pointed out hereinabove, the invention is especially applicable to cleaner assemblies of the canister type, as illustrated in FIG. 3, wherein the canister 60 has internal walls 61 and 62 dividing its interior into a central chamber 63 and opposite end chambers 64 and 65. Multiple cleaners 10 of the construction described in connection with FIG. 1 are shown as mounted within the canister 60, with the interior walls 61 and 62 and end wall 66 providing the same mounting and partitioning functions as the partitions 12 and 13 and end wall 34 in FIG. 1.

The operation of a canister cleaner assembly of the invention as shown in FIG. 3 is the same as already described in connection with FIG. 1. The chamber 64 serves as the feed chamber and is provided with an appropriately located port for receiving the inlet flow of feed stock, and the chambers 63 and 65 become the reject and accept chambers as described in connection with the chambers 16 and 17 in FIG. 1. It should also be noted that the canister cleaner of FIG. 3 can in effect can be made double-ended by doubling the length of the canister, installing a second set of partition walls and cleaners opposite the set shown in FIG. 3, and then using chamber 64 as the feed chamber for both sets of cleaners.

Figure 4:
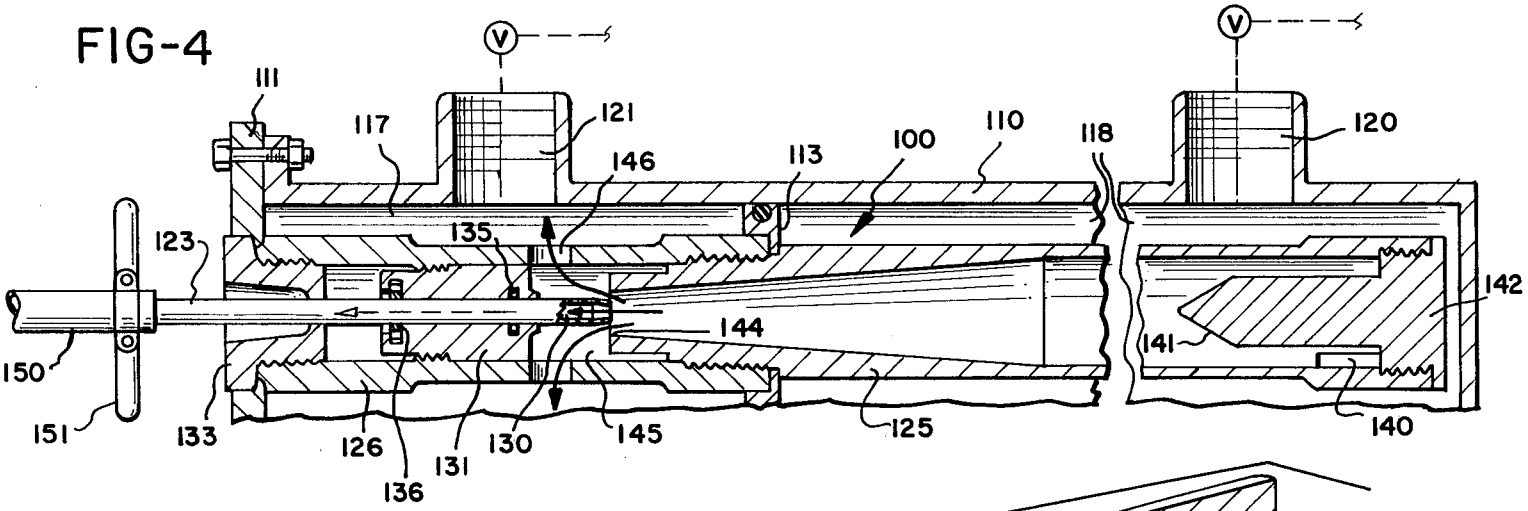
FIG. 4 is a view similar to FIG. 1 showing a reverse cleaning unit incorporating a modified discharge tube arrangement for the light fraction.

The modified cleaner 100 in accordance with the invention shown in FIG. 4 is mounted in a canister casing 110 provided with an end head 111 and having its interior divided by a partition 113 into a supply or feed chamber 115 and an accepts (heavies) chamber 117. Each of these chambers is provided with its own port 120 and 121 respectively, but each cleaner 100 has its own outlet port for reject (lights) from the casing 110 provided by a tube 123 as described in more detail hereinafter.

The cleaner 100 comprises a main tubular vessel 125 of essentially the same construction as the vessel 25 except that it is extended somewhat longer at its apex end, and it has no outlet port in its side wall. The tip housing 126 is threaded on the smaller end of the vessel 125 in clamping relation with the partition 113, and it also serves as a mounting for the tube 123, the bore 130 of which forms the discharge port for lights from the cleaner. A guide member 131 within the housing 126 has an axial bore 132 sized to receive the tube 123 freely therein. The outer portion of the tube 123 passes through a center bore in the threaded cap 133 which clamps the end of the housing 126 to the end head 111 of the casing 110.

The bore 132 of the part 131 is provided with a circumferential groove for receiving an O-ring 135 sized to form a seal between the bore 132 and the tube 123. In addition, releasable locking means are provided between the tube 123 and the part 131, namely bayonet locking means comprising radial projections 136 on the tube 123 which are sized to cooperate in locking relation with the slotted and grooved portions at the outer end of the part 131. As shown, when the tube 123 is inserted in the part 131 with its projections 136 aligned with the slots 137 in the end of part 131, the projections 136 will seat on the bottoms of those slots, and then a quarter-turn of the tube will effect locking engagement of the projections 136 in the grooves 138.

The feed inlet port to the interior of the vessel 125 is provided by one or more tangential slots 140 of rectangular shape in the wall of the vessel adjacent its base end, which is closed by a threaded plug 142. An extension 141 on the plug 142 acts both as a vortex finder and as a stabilizer for the air core which forms during operation of the cleaner, and it may be solid as shown or of the hollow cylindrical form shown in FIGS. 1 and 3.

The locking projections 136 on the tube 123 are in predetermined spaced relation with the inner end of the tube so that when they are locked in the grooves 138, the inner end of the tube is located at or within the apex end of the vessel 125 so that it defines an annular discharge port 144 from the interior of the vessel 125 into the annular chamber 145 surrounding the tube 123 on the upstream side of the part 131. A plurality of ports 146 in the wall of the housing 126 lead from this chamber 145 into the accepts chamber 117 and then to the port 121.

The operation of the cleaner assembly shown in FIG. 4 is essentially the same as described in connection with FIG. 1, with the centrifugal force conditions developed within the vessel 125 causing vortical separation of the feed slurry into an outer fraction which is discharged through the annular port 144 and an inner fraction which is discharged through the tube 123. The major advantage provided by this cleaner is that in the event of plugging of the annular port 44 by solid material, virtually immediate relief of the blocking can be effected by manually retracting the tube 123 from outside the casing 110 for a long enough interval for the flow to clear the apex end of the vessel 125, and then returning the tube 123 to its operating position established by the locked relation of the parts 136–138.

In order to take advantage of this feature of the invention, when multiple cleaners 100 are incorporated in a single canister casing 110, all of the tubes 123 project to the outside of the canister, and each is provided with its own flexible tubing 150 for conducting the reject flow therefrom to a common collection receiver. In order to facilitate the use of the tubes 123 for relieving blockage, each tube has its tubing 150 secured thereto by a clamp 151 which also acts as a handle by which the associated tube 123 can be twisted to unlocked position, temporarily retracted, and then returned and locked in its operative position.

Figure 5:
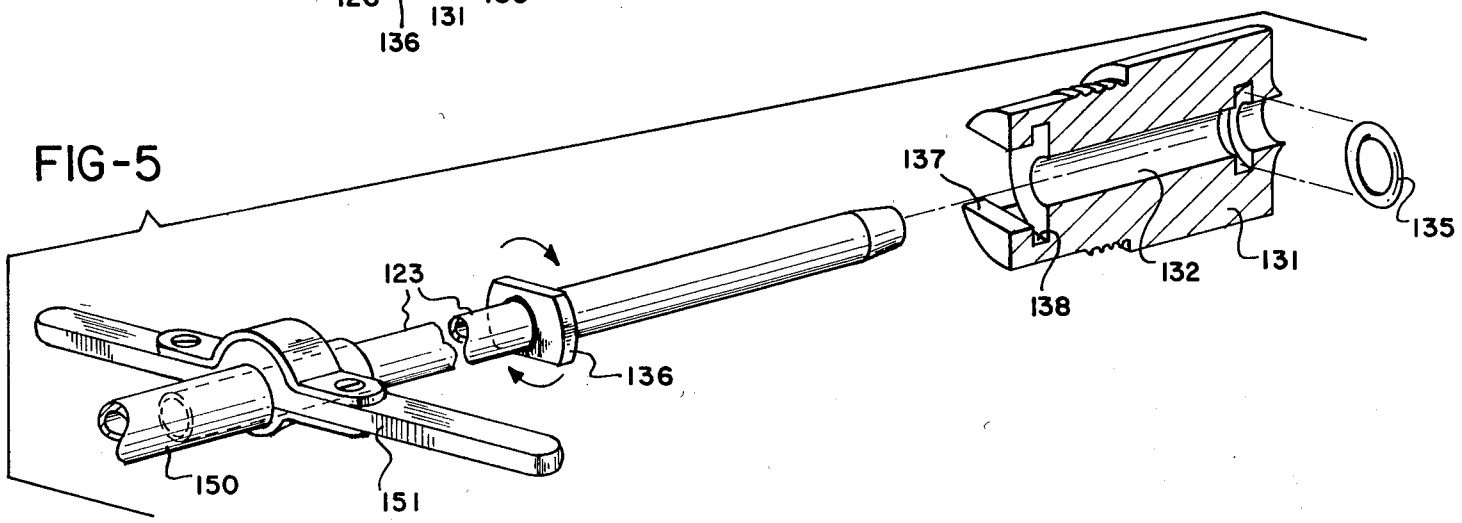
FIG. 5 is a fragmentary exploded isometric view illustrative details of the mechanism for releasably locking discharge tube of the cleaner in FIG. 4 in operative position.

In a typical example of the cleaner shown in FIGS. 4–5 wherein the inner diameter of the cylindrical portion of the vessel 125 is three inches, the inner diameter of the apex end of the vessel is 1.14 inches, there are four ports 146 one inch in diameter, the tube 123 has an outer diameter of 0.625 inch and an inner diameter of 0.500 inch, and it is preferably beveled at its upstream end to minimize turbulence in the flow therepast. In addition, the space between the inner end of the cap 133 and the downstream end of the member 131 provides for at least one inch of axial movement of the tube 123 to assure complete opening of the apex end of the vessel 125 when the tube is retracted. At the same time, abutting of the locking projections 136 against the end of cap 133 limits retraction of tube 123 sufficiently so that it is not retracted beyond the O-ring 135, and thus the unit remains sealed against leakage past tube 123.

While the process and forms of apparatus herein described constitute preferred embodiments of this invention, it is to be understood that the invention is not limited to this precise process and these forms of apparatus, and that changes may be made therein without departing from the scope of the invention.

What is claimed is:

1. A centrifugal cleaner particularly adapted for the treatment of paper making stock containing light contaminant materials of similar and lower specific gravities to separate the paper making fibers therein from said light contaminant materials comprising:

(a) a main tubular vessel enclosing a frustoconical interior space and having the apex end thereof open and of predetermined diameter which is substantially less than the maximum diameter of said space, (b) means defining an inlet port to said space adjacent the other end of said vessel for delivering said paper making stock to said space, (c) said inlet port means being constructed and arranged to deliver said stock to said space with a substantial circumferential flow component causing vortical separation of said stock into an outer flow fraction containing the large majority of said paper fibers and an inner flow fraction containing the large majority of said light contaminant materials, (d) housing means secured to the apex end of said vessel and defining a chamber aligned and in open communication with said open apex end of said vessel, (e) said housing means including means defining a discharge port from said chamber, (f) an outlet tube of smaller outer diameter than said open apex end of said vessel, (g) means supporting said outlet tube in said housing means for axial movement in substantially coaxial relation with said open apex end of said vessel, (h) said tube being of sufficient length that with one end portion thereof inserted within said open apex end of said vessel, the opposite end portion thereof extends through said supporting means to space outside of said housing, (i) means for securing said tube to said supporting means with said one end of said tube inserted within said open apex end of said vessel, (j) said one end of said tube being of predetermined sufficiently smaller outer and inner diameter than the inner diameter of said open apex end of said vessel to define therewith, when inserted therein, an annular outlet port leading from said frustoconical space to said chamber which is of substantially greater flow area than the flow area through said tube to receive said fiber-containing outer flow fraction, (k) whereby the flow through said tube is correspondingly less than the flow through said annular outer port and comprises said light contaminant-containing inner flow fraction, and (l) means for effecting release of said securing means from said support means to provide for temporary axial retraction of said tube one end portion from said open apex end into said chamber to effect complete opening of said apex end of said vessel for discharge from said vessel into said chamber of contaminant material trapped in said annular outlet port without interrupting the operation of said cleaner.

2. A centrifugal cleaner as defined in claim 1 wherein said securing means include means limiting movement of said tube toward said vessel to an operating position wherein said one end of said tube extends a predetermined distance into said open apex end of said vessel.

3. A centrifugal cleaner as defined in claim 1 wherein said tube is cylindrical, and said securing means comprises complementary means on said tube and in said supporting means which interlock and release respectively in response to partial rotation of said tube in one or the other rotational sense.

4. A centrifugal cleaner as defined in claim 3 wherein said tube is of sufficient length that when the tube is in said operating position, said other end portion thereof projects into said space outside of said housing to form a handle for rotation and withdrawal thereof.

5. A centrifugal cleaner as defined in claim 1 wherein said supporting means includes means sealing against leakage of liquid between the outer surface of said tube and said supporting means, and further comprising means limiting retraction of said one end of said tube beyond said sealing means.

* * * * *